US009759174B2

(12) United States Patent
Lucas et al.

(10) Patent No.: US 9,759,174 B2
(45) Date of Patent: Sep. 12, 2017

(54) CONSTANT PRESSURE SELF-REGULATING COMMON RAIL SINGLE PISTON PUMP

(71) Applicant: Stanadyne Corporation, Windsor, CT (US)

(72) Inventors: Robert G. Lucas, Ellington, CT (US); Yevgeniy Norkin, Longmeadow, MA (US)

(73) Assignee: Stanadyne LLC, Windsor, CT (US)

( * ) Notice: Subject to any disclaimer, the term of this patent is extended or adjusted under 35 U.S.C. 154(b) by 110 days.

(21) Appl. No.: 14/433,407

(22) PCT Filed: Jul. 10, 2013

(86) PCT No.: PCT/US2013/049861
§ 371 (c)(1),
(2) Date: Apr. 3, 2015

(87) PCT Pub. No.: WO2015/005915
PCT Pub. Date: Jan. 15, 2015

(65) Prior Publication Data

US 2015/0252768 A1 Sep. 10, 2015

(51) Int. Cl.
*F02M 59/00* (2006.01)
*F02M 63/02* (2006.01)
(Continued)

(52) U.S. Cl.
CPC ..... *F02M 63/0265* (2013.01); *F02M 59/46* (2013.01); *F02M 59/464* (2013.01); *F02M 63/005* (2013.01); *F02M 63/0056* (2013.01)

(58) Field of Classification Search
CPC ..... F02M 63/0235; F02M 63/0245; F02M 63/025; F02M 63/026; F02M 59/205; F02M 59/34; F02M 59/464
(Continued)

(56) References Cited

U.S. PATENT DOCUMENTS 6,058,912 A * 5/2000 Rembold ..... F02D 41/3082 123/179.17
6,135,090 A * 10/2000 Kawachi ..... F02D 41/3809 123/446
(Continued)

FOREIGN PATENT DOCUMENTS

JP 2011-226485 A 11/2011
WO WO 2012/089378 A1 7/2012

OTHER PUBLICATIONS

International Search Report, PCT/US2013/049861, dated Dec. 20, 2013.

*Primary Examiner* — Thomas Moulis
(74) *Attorney, Agent, or Firm* — Alix, Yale & Ristas, LLP

(57) ABSTRACT

The pump delivered pressure is regulated to a substantially constant set value, and output flow is varied by an inlet metering valve (5) via feedback from the motion of, or flow from the spilled fuel through, a delivered pressure regulator (13, 19). The pressure regulating element can be biased to close a seal surface (12') against flow from the outlet side of the pump (14) toward the inlet metering valve when the pump is turned off, thereby holding sufficient rail pressure to prevent boiling during hot soak conditions. In another aspect, a flow stabilization orifice (18) is provided between the outlet of the pump and the inlet metering valve, e.g., upstream of the pressure regulating element. In yet a further aspect, the inlet metering valve is hydraulically responsive (6, S, L) to changes in flow resulting from movement of the pressure responsive element (13).

23 Claims, 6 Drawing Sheets

(51) Int. Cl.
*F02M 63/00* (2006.01)
*F02M 59/46* (2006.01)

(58) Field of Classification Search
USPC ..... 123/457–458, 446–447
See application file for complete search history.

(56) References Cited

U.S. PATENT DOCUMENTS

| | | | | |
|---|---|---|---|---|
| 7,182,067 | B2 * | 2/2007 | Ricco | F02D 41/3845 123/300 |
| 7,712,453 | B2 * | 5/2010 | Nonoyama | F02M 51/005 123/458 |
| 9,297,331 | B2 * | 3/2016 | Glugla | F02D 41/3845 |
| 9,399,976 | B2 * | 7/2016 | Ramamurthy | F04B 1/0404 |
| 2002/0096145 | A1 | 7/2002 | Ricco et al. | |
| 2003/0098016 | A1 * | 5/2003 | Rembold | F02D 41/3854 123/457 |
| 2009/0084355 | A1 * | 4/2009 | Vogt | F02M 59/20 123/447 |
| 2011/0209687 | A1 * | 9/2011 | Schroeder | F02M 63/005 123/459 |

* cited by examiner

CONSTANT PRESSURE SELF-REGULATING COMMON RAIL SINGLE PISTON PUMP

BACKGROUND

Gasoline direct injection (GDI) fuel systems are a cost adder to OEM vehicle manufacturers compared to conventional metered pump inlet (MPI) systems. In the past few years, there have been significant gains in driving down the cost of the GDI fuel pump by simplification and size reduction. Demand control output requirements have kept the need for using a rather expensive solenoid operated control valve on conventional pump executions. On-board display (OBD), software, and electrical hardware requirements also add cost and are necessary due to the electronic control requirements of the pump.

SUMMARY OF THE INVENTION

The disclosed concept simplifies and reduces the cost of a GDI single piston pump execution on a vehicle by eliminating the electronic control. This simplifies the system by eliminating the pump driver, wiring, software code, OBD, and the pump electronic control device. The pump delivered pressure is regulated to a substantially constant set value, and output flow is varied by an inlet metering valve via feedback from the motion of, or flow from the spilled fuel through, the delivered pressure regulator. As engine demand varies, so does the flow rate through the delivered pressure regulator and degree of inlet metering. This combination of pressure regulation and inlet metering provides the required substantially constant delivered pressure, and minimizes heat generation due to excessive spilled high pressure fuel during mid to high speed operation.

In one aspect, means are provided for closing a seal surface against flow from the common rail toward the pressure regulating element when the pressure in the common rail drops below a threshold value. The pressure regulating element can be biased to close the seal surface against flow from the outlet side of the pump toward the inlet metering valve when the pump is turned off. The pump is driven by a vehicle engine and the threshold value corresponds to the reduced pressure in the common rail shortly after the engine is turned off, thereby holding sufficient pressure to prevent boiling in the rail during hot soak conditions while the pump is not operating.

In another aspect, a flow stabilization orifice is provided between the outlet of the pump and the inlet metering valve, e.g., upstream of the pressure regulating element.

In yet a further aspect, the inlet metering valve is hydraulically, rather than mechanically, responsive to movement of the pressure regulating element.

The features of closing a seal surface against flow from the common rail toward the regulating element when the pressure in the common rail drops below a threshold value and the flow stabilization orifice upstream of the inlet metering valve can be provided separately or in combination and with either hydraulic or mechanical interaction between the pressure regulating element and the inlet metering valve.

BRIEF DESCRIPTION OF THE DRAWING

Exemplary embodiments will be described with reference to the accompanying drawing, in which.

DESCRIPTION OF REPRESENTATIVE EMBODIMENTS

Figure 1:
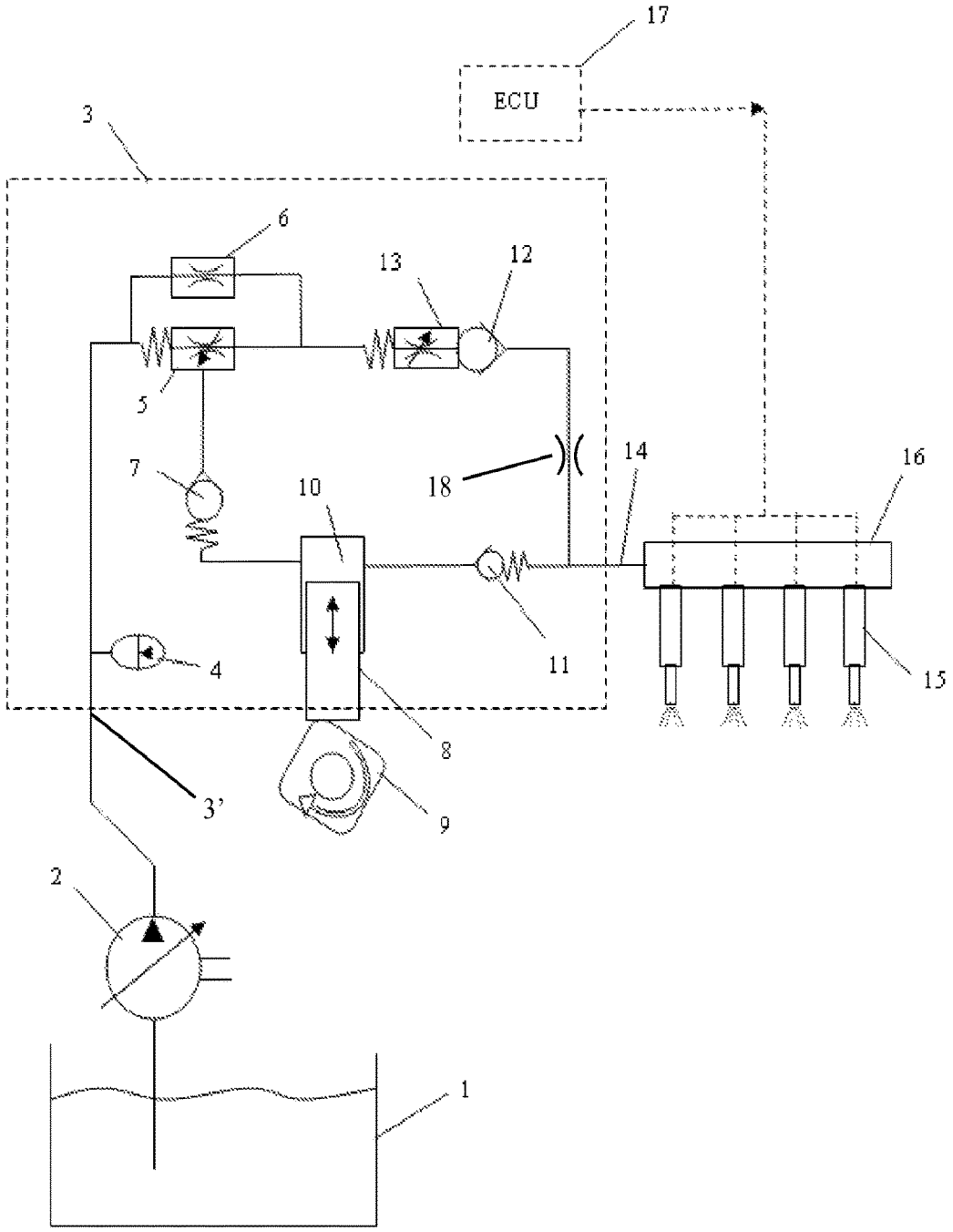
FIG. 1 is a system schematic for a pump in which the inlet metering valve is hydraulically responsive to the outlet flow of the pressure regulating element, a check valve is provided for closing a seal surface against flow from the common rail toward the regulating element when the pressure in the common rail drops below a threshold value, and a flow stabilization orifice is provided upstream of the inlet metering valve.
Figure 2:
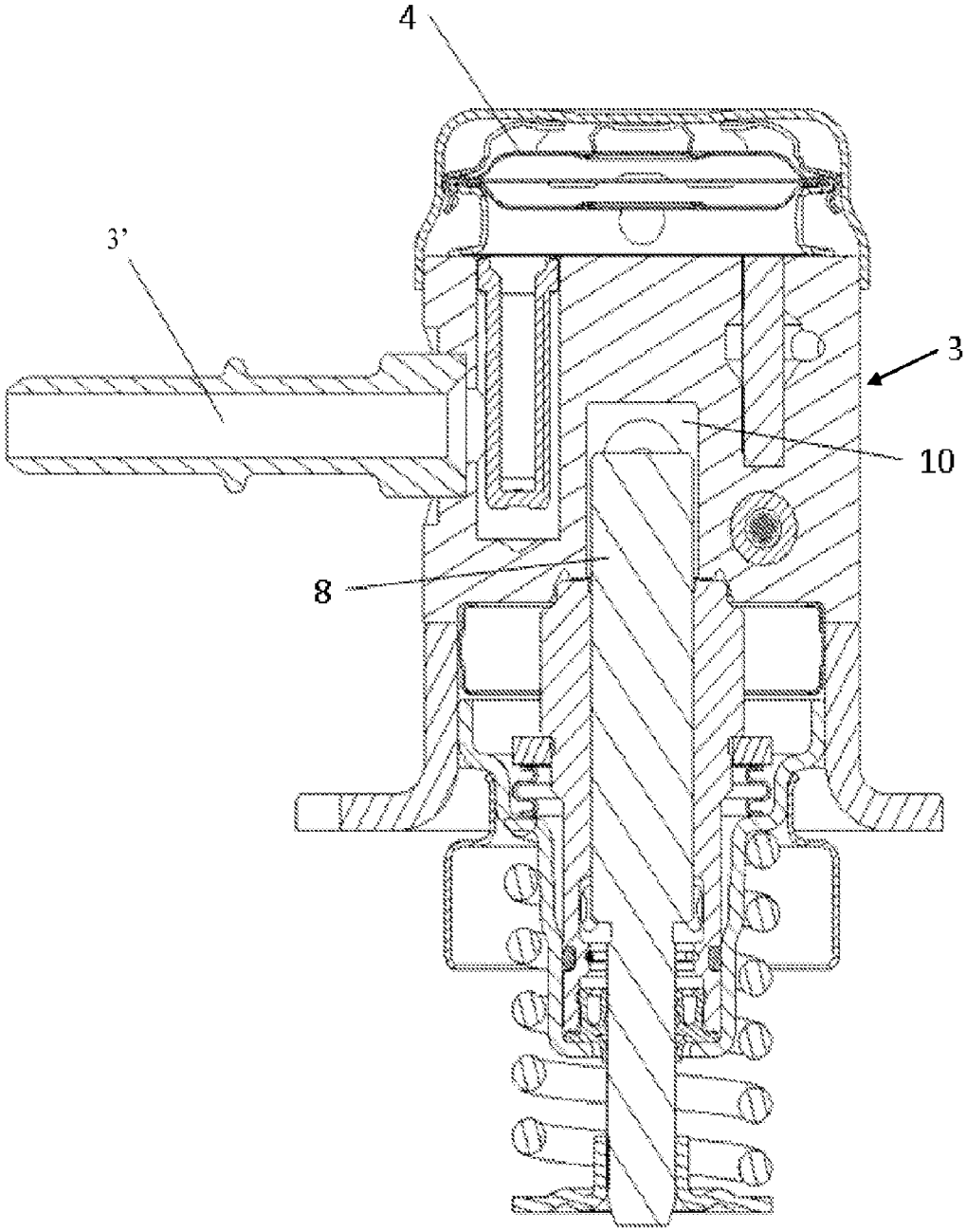
FIGS. 2-5 show various cross sections of how the system of FIG. 1 without the flow stabilizing orifice, can be implemented.
Figure 3:
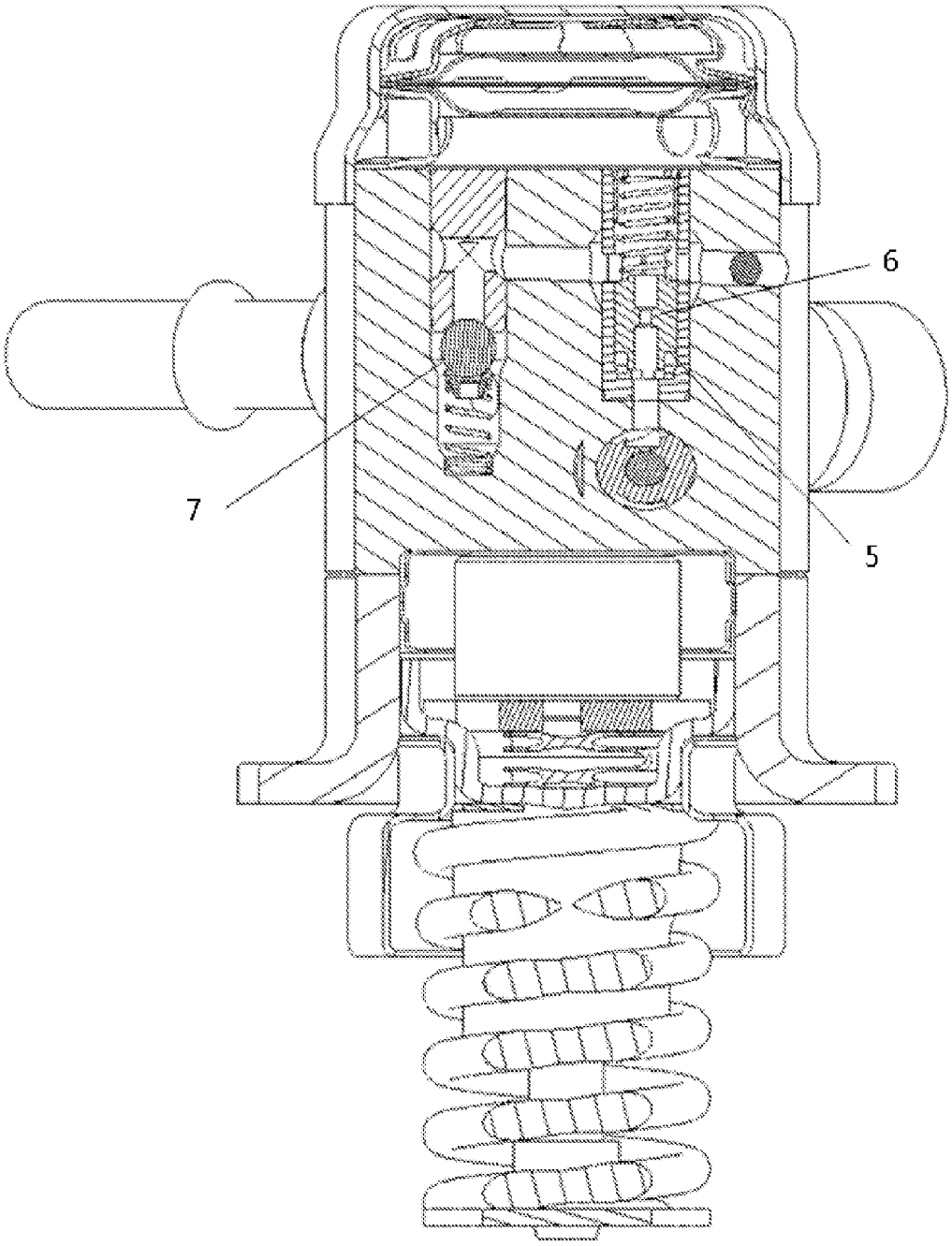

FIGS. 1-5 show a fuel pump system in first embodiment, in which fuel is drawn from the fuel tank 1 by the low pressure feed pump 2, and delivered to the high pressure single piston GDI pump 3 via inlet port or passage 3'. The inlet fuel passes by a pressure damper 4 to the inlet metering valve 5, inlet check valve 7, and into the pumping chamber 10 during a downward charging stroke of piston 8, which is actuated by cam 9 driven by the engine rotation. During the pumping stroke of the piston 8, the pressurized fuel passes through the outlet check valve 11, high pressure outlet line 14 and into the common rail 16. The injectors 15 are commanded by the electronic control unit (ECU) 17 to spray the desired fuel quantity based on the engine demand.

Figure 4:
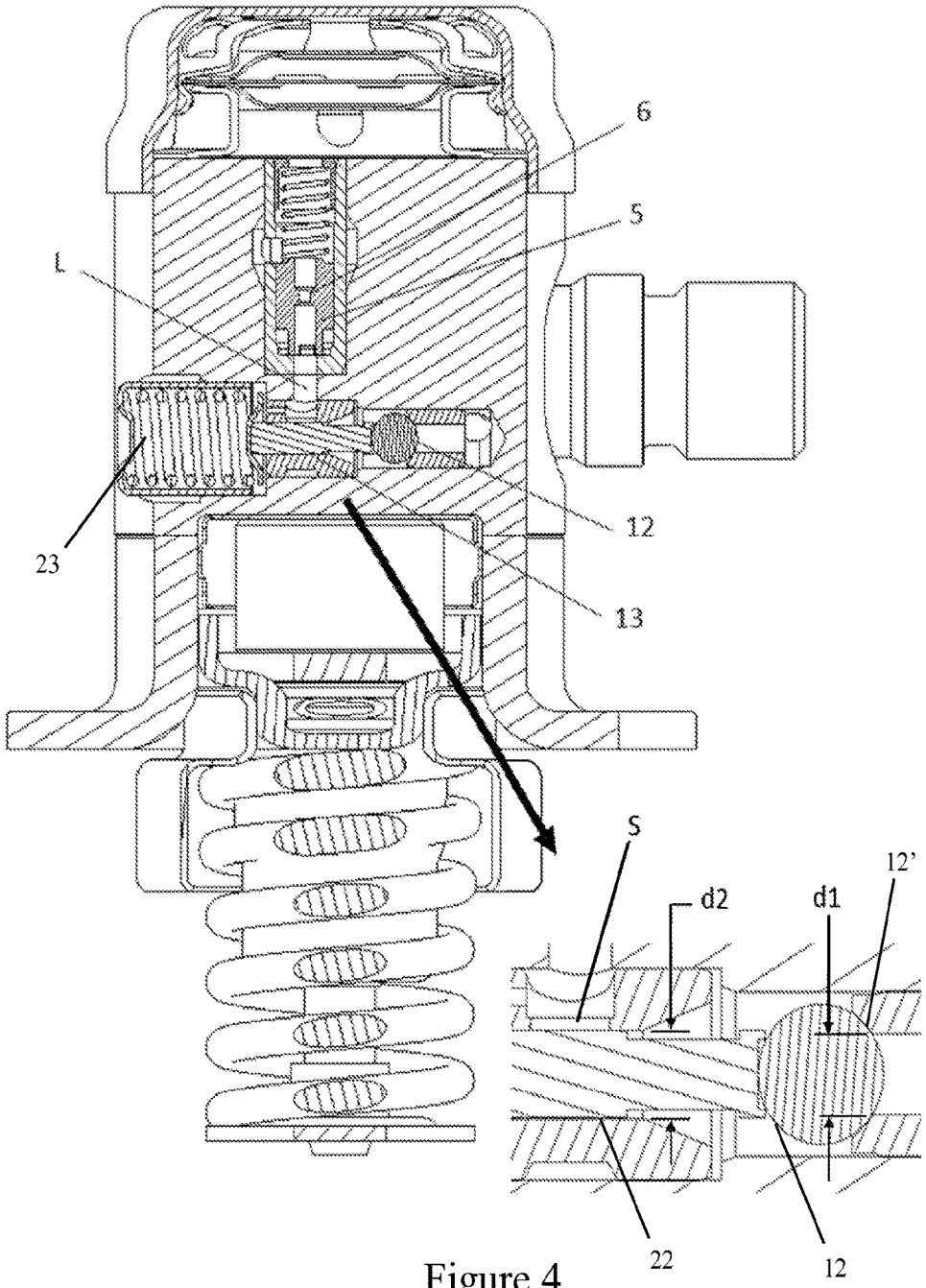
Figure 5:
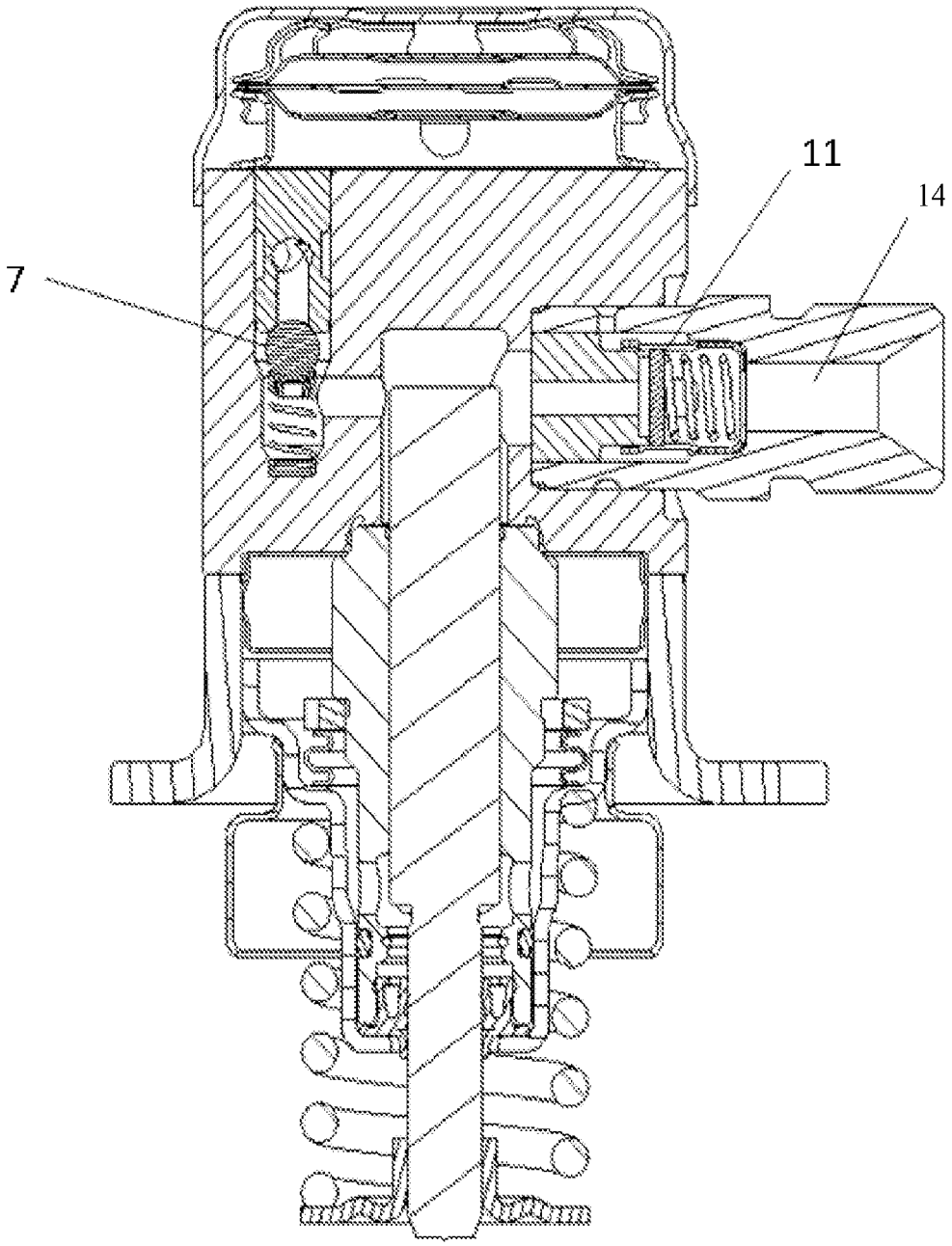

The pressure of the high pressure line 14 and rail 16 is controlled to a substantially constant pressure by the delivered pressure regulator 13. The check ball 12 provides a positive seal during engine shut down, thereby holding rail pressure to prevent boiling during hot soak conditions. The sealing diameter of the check ball 12 is smaller than the delivered pressure regulator sealing diameter, as shown at d1 and d2 of FIG. 4. This allows the ball to open at a pressure lower than the regulated pressure during engine starting, and then move away from its sealing surface at seat 12' during engine operation, allowing unimpeded flow to the delivered pressure regulator 13. Spilled fuel from the delivered pressure regulator 13 (which incorporates or is operatively associated with a variable flow metering orifice S and passage L as shown in FIG. 4) is in communication with a bleed control 6 and inlet metering valve 5 hydraulically in parallel to each other.

At slow engine speeds when heat is of no concern, the spilled fuel will pass through the control orifice 6 to the inlet side at the pressure of inlet passage 3', building little pressure on the inlet metering valve 5, and no inlet metering will occur. At this point, the pump is in "full recirculation mode" where the pump regulates the entire geometric displacement through the delivered pressure regulator 13. As speed increases (and especially when injector demand is low), the flow rate through the delivered pressure regulator 13 and orifice 6 increases, increasing the pressure acting on the inlet metering valve 5. The metering valve 5 then moves, progressively closing off inlet flow to the inlet check valve 7 and pumping chamber 10. This subsequently reduces the output of the next pumping event, and the amount of recirculated high pressure fuel through the delivered pressure regulator 13, keeping heat buildup to a minimum. The interaction between the delivered pressure regulator 13 and inlet metering valve 5 reacts to both changes in engine speed and demand (injector flow), because both will affect the flow rate through the delivered pressure regulator 13.

A stabilizing flow orifice 18 is preferably situated upstream of the metering orifice S, especially upstream of the check ball sealing surface 12', to damp out dynamic pressure spikes.

Figure 6:
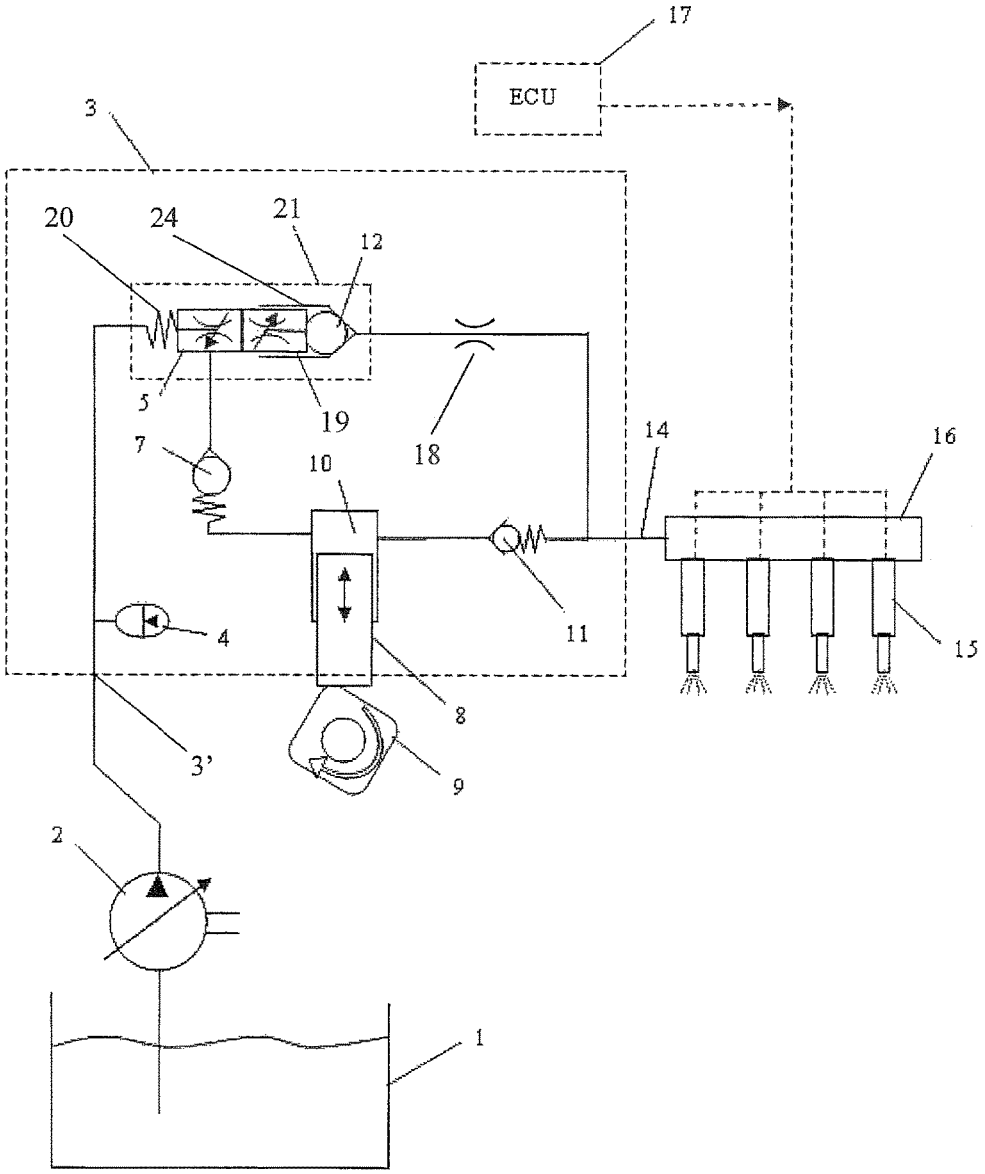
FIG. 6 is a system schematic corresponding to FIG. 1, for a pump in which the inlet metering valve is mechanically responsive to the movement of the pressure regulating element, a check valve is provided for closing a seal surface against flow from the common rail toward the regulating element when the pressure in the common rail drops below a threshold value, and a flow stabilization orifice is provided upstream of the inlet metering valve.

FIG. 6 shows a system schematic of another embodiment. Fuel is drawn from the fuel tank 1 by the low pressure feed pump 2, and delivered to the inlet passage 3' of the high pressure single piston GDI pump 3. The inlet fuel passes by a pressure damper 4 to the inlet metering valve 5, inlet check valve 7, and into the pumping chamber 10 during a downward charging stroke of piston 8. During the pumping stroke of the piston 8, the pressurized fuel passes through the outlet check valve 11, high pressure outlet line 14 and into the rail 16. The injectors 15 are commanded by the ECU 17 to spray the desired fuel quantity based on the engine demand. The pressure of the high pressure line 14 and rail 16 is controlled to a substantially constant pressure by the regulating element 19 with energizing spring 20 in spool valve assembly 21. The check ball 12 provides a positive seal during engine shut down, thereby holding rail pressure to prevent boiling during hot soak conditions.

In this embodiment, the pressure regulating element is a piston 19 that does not include a control orifice that spills fuel back to the low pressure side of the pump, but instead only spills a small amount of leakage along the close fit of the piston outside diameter. The inlet metering valve 5 is mechanically coupled to the regulating piston 19, such that motion of the regulating piston 19 results in motion of the inlet metering valve 5. Because there is very small leakage past this piston 19 it reacts to changes in the rail 16 and high pressure line 14. An increase in pressure will move the piston 19 and coupled inlet metering valve 5 to a more throttled position, reducing the charged flow into the pumping chamber and thus reducing the rail and high pressure line pressure during the next pumping event. A drop in rail pressure will move the regulating piston 19 and coupled inlet metering valve 5 to a less throttled position, increasing the charged flow into the pumping chamber and thus increasing the rail and high pressure line pressure during the next pumping event. Changes in engine speed and load (injector flow) will increase or decrease the pressure signal applied to the regulating piston 19.

By analogy to FIG. 1, a stabilizing flow orifice 18 is situated upstream of the regulating piston 19 to damp out dynamic pressure spikes, giving the regulating piston a cleaner signal from which to react. A low rate spring 20 in assembly 21 is desired to minimize the rail pressure variation. Because of the low leakage past the regulator piston 19, this embodiment has superior pump efficiency, especially at low speeds.

It should be appreciated that items 13 and 19 can be considered pressure responsive elements (i.e., for regulating pressure) which change position with changes in applied pressure. The pressure regulator 13 of FIG. 4 can be considered a piston type back pressure regulator. This can be generalized as comprising a stem 22 with biasing spring 23 that bears on the ball 12, and, due to a profile on the stem and/or the orifice S, variably seals against orifice S. In this configuration, the rail pressure regulation can work independent of the inlet metering valve. In the embodiment of FIG. 8, the pressure regulation only occurs when the regulator piston 19 is used in conjunction with the inlet metering valve 5 which varies flow rate to the inlet side of the pump, thereby regulating the rail pressure. The metering orifice 5 can thus be varied by the movement of valve 5 as urged by or as an integral extension of piston 19. Accordingly, the inventive device can be implemented with any of many types of pressure responsive elements.

It should also be appreciated that the check ball 12 is not necessary; any seal surface on the upstream face of an element such as piston 19 could seat directly against a seal surface at the backflow opening in the split line from outlet check 11.

Preferably, the flow area of the channel before (upstream) and after (downstream) the orifice 18 is at least twice the flow area of the orifice. The channel after the orifice 18 can optionally be further enlarged as chamber 24 for receiving one (upstream) end of the regulator piston 19. Although the end of that piston must be in hydraulic communication with the channel after the orifice 18, a chamber can be provided without entry of the piston. However, the diameter of the regulator piston 19 should be at least five times the diameter of the orifice 18. The check ball 12 has no bearing on normal function during engine running conditions.

During normal running conditions, the check ball 12 is unloaded (when outlet pressure reaches the opening pressure during startup) and "drops" out of the way. It is not reseated until the engine is turned off. When the engine shuts off, the pump stops pumping and the injectors 15 close fully. At that instant, rail pressure at 14 and 16 is still forcing the regulator piston 19 into a highly throttled position (because the engine shut down during an idle condition) and the check ball 12 is away from the sealing seat. Leakage past the OD of the regulator piston 19 back to the into the inlet passage/circuit will allow rail pressure to drop, thereby allowing the regulator piston 19 to move via its spring load until the ball 12 is forced against the sealing seat. Then the rail pressure will be sealed. This leak-down takes only a few seconds.

Key advantages relative to known pumps include: (i) addition of a properly sized orifice and (preferably) a volume chamber between the pump outlet and regulator piston provides a stable pressure signal, eliminating fuel delivery surges during high speed operation as well as speed and injector load transients and (ii) addition of the check ball seals rail pressure from bleeding down during a hot soak, avoiding leakage past the regulator piston that allows rail pressure to bleed down during a hot soak, causing a difficult vehicle hot start condition.

The invention claimed is:

1. A high pressure single piston fuel pump with a fuel inlet passage (3') leading to a pumping chamber (10), where fuel is pressurized and delivered in an outlet line (14) to a common rail (16) and thereby establishes a rail pressure, wherein the improvement comprises that:

(a) the rail pressure is regulated by a self-contained pressure regulating element (13, 19) in hydraulic communication with the outlet line and a self-contained inlet metering valve (5) in hydraulic communication with the inlet passage;

(b) the inlet metering valve is responsive to variations of the pressure regulating element resulting from variations in the pressure in the outlet line, thereby metering the inlet flow to the pumping chamber; and (c) a seal surface (12') closable against flow from the common rail toward the pressure regulating element when the pressure in the common rail drops below a threshold value.

2. The pump of claim 1, wherein said pressure regulating element (13, 19) is biased to close the seal surface against flow from the outlet line of the pump toward the inlet metering valve when the pump is turned off.

3. The pump of claim 1, wherein the pump is operatively driven by a vehicle engine and said threshold value corresponds to a reduced pressure in the common rail shortly after the engine is turned off, thereby holding rail pressure to prevent boiling during hot soak conditions while the pump is not operating.

4. The pump of claim 1, wherein the pressure regulating element comprises a stem (22) that is biased against a check ball (12) to close the seal surface against flow toward the inlet metering valve when the pump is turned off.

5. The pump of claim 1, wherein the pressure regulating element comprises a stem (22) that is displaceable to vary the flow through a metering orifice (S) associated with the metering valve (5).

6. The pump of claim 5, including a flow stabilization orifice (18) in fluid communication with the outlet line of the pump, upstream of the metering orifice (S).

7. The pump of claim 1, including a flow stabilization orifice (18) in fluid communication with the outlet line of the pump, upstream of the sealing surface (12') that closes when the pressure in the common rail drops below a threshold value.

8. The pump of clam 1, wherein the inlet metering valve is mechanically coupled to the pressure regulating element (19), and motion of the pressure regulating element and inlet metering valve meters inlet flow to the pumping chamber.

9. The pump of claim 1, wherein an inlet check valve (7) is in fluid communication with a fuel inlet passage (3'); a pumping piston (8) reciprocates in a bore;

the pumping chamber (10) is associated with the bore and piston, for receiving low pressure fuel from the inlet passage through the inlet check valve in a charging phase and delivering fuel at increased pressure to the pump outlet line (14) through an outlet check valve (11) in a discharge phase;

a metering orifice (S) having a variable flow area is in fluid communication between the pump outlet line and the inlet check valve (7);

said pressure regulating element (13, 19) has one end in fluid communication with the pump outlet line and is axially displaceable to vary the flow area of the metering orifice (S) and thereby meter the flow of fuel through the inlet check valve to the pumping chamber during the charging phase; and said pressure regulating element is biased to close the seal surface against flow from the outlet line of the pump toward the inlet metering valve when the pump is turned off.

10. The pump of claim 9, wherein the inlet metering valve (5) is distinct from the pressure regulating element (13), and has an upstream side in fluid communication with said inlet passage and a downstream side in fluid communication with the inlet check valve (7);

the pressure regulating element (13) comprises a stem (22) that is biased against a check ball (12) to close the seal surface against flow toward the inlet metering valve (5) when the pump is turned off;

the sealing diameter (d1) of the check ball against said seal surface is smaller than the sealing diameter (d2) of the stem associated with said orifice (S), whereby the check ball opens at a pressure lower than the regulated pressure during engine starting, then moves away from its seat during engine operation, allowing unimpeded flow to the pressure regulating element (13); and spilled fuel from the pressure regulating element (13) is in fluid communication with the inlet passage.

11. The pump of claim 10, wherein spilled fuel from the pressure regulating element (13) is in parallel fluid communication with the upstream side of a control orifice (6) to the inlet passage and the metering valve.

12. The pump of claim 1, wherein, the inlet metering valve (5) has an upstream side in fluid communication with said inlet passage and a downstream side in fluid communication with an inlet check valve (7) leading to the pumping chamber;

the pressure regulating element comprises a stem (22) that is biased against a check ball (12) to close a seal surface against flow toward the inlet metering valve (5) when the pump is turned off; and the check ball opens at a pressure lower than the regulated pressure during engine starting, then moves away from its seat during engine operation, allowing unimpeded flow to the pressure regulating element.

13. The pump of claim 7, wherein the pressure regulating element is a regulator piston (19) having an upstream face exposed to fluid pressure in a volume chamber (24) downstream of the stabilization orifice (18) and the regulator piston (19) reacts to the pressure of the volume chamber (24).

14. The pump of claim 13, wherein the stabilization orifice (18) has a flow area less than 0.200 $mm^2$.

15. The pump of claim 13, wherein the regulator piston is biased to load a check ball against fuel pressure at the outlet line of the pump and sealingly close the check ball when the fuel pressure at the outlet line falls below a pre-set threshold value.

16. The pump of claim 15, wherein the sealing diameter of the check ball is between 0.5 and 1.5 times the sealing diameter of the regulator piston.

17. The pump of claim 16, wherein the channel after the orifice (18) is enlarged to form said volume chamber (24) for receiving one end of the regulator piston (19).

18. The pump of claim 16, wherein the diameter of the regulator piston is at least five times the diameter of the stabilization orifice (18).

19. The pump of claim 16, wherein when the engine is turned off, leakage of fuel from the common rail past the outside diameter of the regulator piston (19) into the pump inlet passage allows rail pressure to drop, inducing the regulator piston to move under a spring load to close said seal surface, thereby sealing the common rail pressure.

20. A high pressure single piston fuel pump that is pressure regulated by a self-contained pressure regulating element (13, 19) in fluid communication with the outlet side of the pump and is inlet metered by a self-contained inlet metering valve (5) delivering fuel to the piston through an inlet check valve (7) and operatively associated with the pressure regulating element, thereby metering the inlet flow to the inlet check valve, wherein the improvement comprises a flow stabilization orifice (18) between the outlet of the pump and the inlet metering valve, wherein the inlet check valve (7) is in fluid communication with a fuel inlet passage (3'); the pumping piston (8) reciprocates in a bore;

a pumping chamber (10) is associated with the bore and piston, for receiving low pressure fuel from the inlet passage through the inlet check valve in a charging phase and delivering fuel at increased pressure to the pump outlet line (14) through an outlet check valve (11) in a discharge phase;

a variable flow area through a metering orifice (S) is in fluid communication between the pump outlet and the inlet check valve (7);

said pressure regulating element (13, 19) has one end in fluid communication with the pump outlet and is axially displaceable to vary the flow area of the metering orifice(s) and thereby meter the flow of fuel through the inlet check valve to the pumping chamber during the charging phase;

the pressure regulating element is a regulator piston (19) exposed to fluid pressure in a volume chamber (24) downstream of the orifice (18) and the regulator piston (19) reacts to the pressure of the volume chamber (24) to vary the opening area of the metering orifice (S); and the flow stabilization orifice (18) is located between the outlet of the pump and the volume chamber.

21. A high pressure single piston fuel pump that is pressure regulated by a self-contained pressure regulating element (13, 19) in hydraulic communication with the outlet side (14) of the pump and is inlet metered by a self-contained inlet metering valve (5) delivering fuel to the piston through an inlet check valve (7), wherein the inlet metering valve is hydraulically responsive to outlet flow of said pressure regulating element, thereby metering the inlet flow to the inlet check valve.

22. The pump of claim 21, wherein the inlet check valve (7) is in fluid communication with a fuel inlet passage (3'); a pumping piston (8) reciprocates in a bore;

a pumping chamber (10) is associated with the bore and piston, for receiving low pressure fuel from the inlet passage through the inlet check valve in a charging phase and delivering fuel at increased pressure to the pump outlet through an outlet check valve (11) in a discharge phase;

a metering orifice (S) having a variable flow area is in fluid communication between the pump outlet and the inlet check valve (7);

said pressure regulating element (13) has one end in fluid communication with the pump outlet and is displaceable to vary the flow area of the metering orifice and thereby meter the flow of fuel through the inlet check valve to the pumping chamber during the charging phase.

23. The pump of claim 22, wherein the inlet metering valve (5) is distinct from the pressure regulating element (13), and has an upstream side in fluid communication with the inlet passage and a downstream side in fluid communication with the inlet check valve (7).

* * * * *